US011531284B2

(12) United States Patent
Iguchi et al.

(10) Patent No.: US 11,531,284 B2
(45) **Date of Patent: *Dec. 20, 2022**

(54) ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Moegi Iguchi, Kanagawa (JP); Yosuke Tsurumi, Kanagawa (JP); Atsushi Sugawara, Kanagawa (JP); Yoshimasa Fujihara, Kanagawa (JP); Yasuko Torii, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/940,814

(22) Filed: Jul. 28, 2020

(65) Prior Publication Data

US 2021/0294237 A1 Sep. 23, 2021

(30) Foreign Application Priority Data

Mar. 19, 2020 (JP) ..... JP2020-050052

(51) Int. Cl.

| | |
|---|---|
| ***G03G 9/097*** | (2006.01) |
| ***G03G 15/08*** | (2006.01) |
| ***G03G 9/08*** | (2006.01) |
| ***G03G 9/087*** | (2006.01) |
| ***G03G 21/18*** | (2006.01) |

(52) U.S. Cl.

CPC ..... *G03G 9/09775* (2013.01); *G03G 9/0827* (2013.01); *G03G 9/08711* (2013.01); *G03G 15/0865* (2013.01); *G03G 21/1814* (2013.01)

(58) Field of Classification Search

CPC ..... G03G 9/09775; G03G 9/09725; G03G 9/0825

USPC ..... 430/108.1, 108.7

See application file for complete search history.

(56) References Cited

U.S. PATENT DOCUMENTS

| | | | | |
|---|---|---|---|---|
| 10,241,432 | B2 | 3/2019 | Obara et al. | |
| 2005/0136350 | A1* | 6/2005 | Marcello | G03G 9/0804 516/77 |
| 2010/0124433 | A1 | 5/2010 | Matsuura | |

(Continued)

FOREIGN PATENT DOCUMENTS

| | | |
|---|---|---|
| JP | 2010-117617 A | 5/2010 |
| JP | 2018-072694 A | 5/2018 |

*Primary Examiner* — Peter L Vajda

(74) *Attorney, Agent, or Firm* — Sughrue Mion, PLLC

(57) ABSTRACT

An electrostatic image developing toner includes toner particles including a binder resin and a release agent, an external additive A, and an external additive B. At least the external additive A is present on the surface of the toner particles. At least the external additive B is present on the external additive A. The external additive B is an aggregate of two or more particles. The toner particles have an average circularity of 0.8 or more and 0.94 or less. The amount of the release agent present at the surface of the toner particles is 5 area % or more and 30 area % or less based on the total surface area of the toner particles.

18 Claims, 2 Drawing Sheets

(56) References Cited

U.S. PATENT DOCUMENTS

| | | | | |
|---|---|---|---|---|
| 2010/0196817 | A1* | 8/2010 | Sasaki | G03G 15/08 525/437 |
| 2011/0244382 | A1* | 10/2011 | Christopher | G03G 9/09725 430/105 |
| 2012/0156602 | A1* | 6/2012 | Yamazaki | G03G 9/1075 430/105 |
| 2014/0178100 | A1* | 6/2014 | Takahashi | G03G 9/09725 399/269 |
| 2017/0227876 | A1* | 8/2017 | Morooka | G03G 9/1075 |
| 2020/0026210 | A1* | 1/2020 | Hirai | G03G 9/09775 |

* cited by examiner

ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2020-050052 filed Mar. 19, 2020.

BACKGROUND

(i) Technical Field

The present disclosure relates to an electrostatic image developing toner, an electrostatic image developer, a toner cartridge, a process cartridge, an image forming apparatus, and an image forming method.

(ii) Related Art

Techniques such as electrophotography for visualization of image information via electrostatic images are currently used in various fields.

In the related art, electrophotography typically involves visualizing image information through a plurality of steps including forming an electrostatic latent image on a photoreceptor or an electrostatic recording medium using various techniques, developing the electrostatic latent image (toner image) by attaching electroscopic particles, which are called toner, to the electrostatic latent image, transferring the developed image onto a surface of a recording medium, and fixing the transferred image, for example, by heating.

A developer or toner known in the art is disclosed in Japanese Unexamined Patent Application Publication No. 2010-117617 or 2018-72694.

Japanese Unexamined Patent Application Publication No. 2010-117617 discloses a developer including a toner containing at least a resin and a colorant. The toner includes 100 (parts by mass) of toner particles and 1.5 to 3.0 (parts by mass) of an external additive added to the toner particles and has a volume average particle size of 6.5 to 8.0 (μm) and a surface roughness Rzjis, as observed under a scanning probe microscope, of 75.3 to 236.9 (nm).

Japanese Unexamined Patent Application Publication No. 2018-72694 discloses an electrostatic image developing toner containing a toner base particle having, on a surface thereof, an external additive. The external additive includes silica particles A and silica particles B. The silica particles A have a number average primary particle size in the range of 40 to 100 nm and an average circularity in the range of 0.50 to 0.90 and is surface-modified with silicone oil. The silica particles B have a number average primary particle size of 25 nm or more, which is smaller than the number average primary particle size of the silica particles A, and is surface-modified with an alkylalkoxysilane having a structure represented by general formula (1) below or silazane.

$$R_1—Si(OR_2)_3 \qquad \text{General formula (1):}$$

[$R_1$ represents an optionally substituted linear alkyl group having 1 to 10 carbon atoms. $R_2$ represents a methyl group or an ethyl group.]

SUMMARY

Aspects of non-limiting embodiments of the present disclosure relate to an electrostatic image developing toner including a toner particle having an average circularity of 0.8 or more and 0.94 or less and a plurality of external additives. The electrostatic image developing toner has higher low-temperature fixability compared to the case where the amount of release agent present at the surface of the toner particles is less than 5 area % or more than 30 area % based on the total surface area of the toner particle.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic image developing toner including a toner particle including a binder resin and a release agent; an external additive A; and an external additive B. At least the external additive A is present on the surface of the toner particle. At least the external additive B is present on the external additive A. The external additive B is an aggregate of two or more particles. The toner particle has an average circularity of 0.8 or more and 0.94 or less. The amount of the release agent present at the surface of the toner particle is 5 area % or more and 30 area % or less based on the total surface area of the toner particle.

BRIEF DESCRIPTION OF THE DRAWINGS

Exemplary embodiments of the present disclosure will be described in detail based on the following figures, wherein.

DETAILED DESCRIPTION

Figure 1:
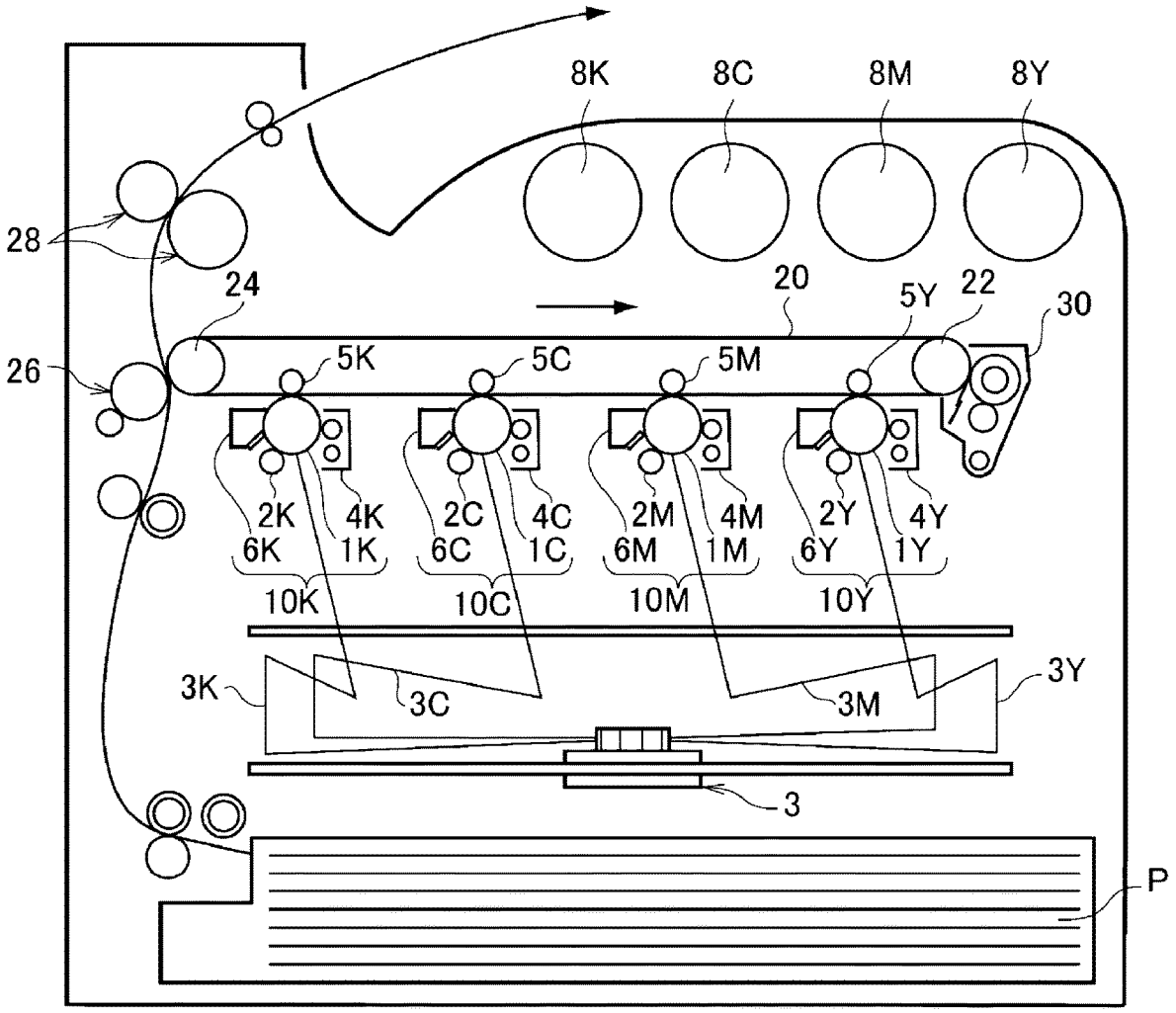
FIG. 1 illustrates a schematic configuration of an image forming apparatus according to an exemplary embodiment.

In this specification, if there are two or more substances corresponding to one component in a composition, the amount of the component in the composition refers to the total amount of the two or more substances in the composition, unless otherwise specified.

In this specification, "electrostatic image developing toner" is also referred to simply as "toner", and "electrostatic image developer" is also referred to simply as "developer".

Exemplary embodiments of the present disclosure will now be described.

Electrostatic Image Developing Toner

An electrostatic image developing toner according to an exemplary embodiment includes toner particles including a binder resin and a release agent, an external additive A, and an external additive B. At least the external additive A is present on the surface of the toner particles. At least the external additive B is present on the external additive A. The external additive B is an aggregate of two or more particles. The toner particles have an average circularity of 0.8 or more and 0.94 or less. The amount of the release agent present at the surface of the toner particles is 5 area % or more and 30 area % or less based on the total surface area of the toner particles.

It is presumed that improvement in transfer properties of a toner of the related art is due to projections and recesses that are created on the surface of toner particles by using an external additive. However, the present inventors have discovered that such projections and recesses alone on a toner particle surface may poorly reduce the resistivity of the entire toner, thus resulting in insufficient low-temperature fixability.

The present inventors have also discovered that in a toner of the related art, an external additive may inhibit bleeding out of a release agent during fixation to reduce low-temperature fixability.

The present inventors have further discovered that when a toner includes nonspherical toner particles and a plurality of external additives, and the external additives and the toner particles have larger gaps therebetween, a release agent is less likely to bleed out during fixation.

The electrostatic image developing toner according to the exemplary embodiment has high low-temperature fixability due to the above configuration. Although not clear, the reasons for this are presumably as follows.

Since the toner particles has an average circularity of 0.8 or more and 0.94 or less and the amount of the release agent present at the surface of the toner particles is 5 area % or more and 30 area % or less based on the total surface area of the toner particles, the release agent is present in a large amount on the toner particle surface. In addition, since at least the external additive A is present on the surface of the toner particles, at least the external additive B is present on the external additive A, and moreover, the external additive B is an aggregate of two or more particles, the external additive B attached onto the external additive A is likely to separate. Thus, bleeding out of the release agent is less easily inhibited, and sufficient bleeding out of the release agent occurs even during low-temperature fixation, whereby the toner has high low-temperature fixability.

Hereinafter, the electrostatic image developing toner according to the exemplary embodiment will be described in detail.

External Additive

The toner according to the exemplary embodiment includes toner particles and an essential external additive.

The toner according to the exemplary embodiment include, as the external additive, an external additive A and an external additive B.

External Additive A

The electrostatic image developing toner according to the exemplary embodiment includes toner particles, an external additive A, and an external additive B, and at least the external additive A is present on the surface of the toner particles.

The external additive A is preferably formed of inorganic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and $SrTiO_3$.

In particular, silica particles are preferred.

The external additive A is preferably formed of wet-process silica particles, more preferably sol-gel silica particles. Since the sol-gel silica particles contain a moderate amount of water, a toner to which the sol-gel silica particles are externally added readily achieves an expected charge amount upon being stirred in a developing device.

The water content of the sol-gel silica particles can be estimated on the basis of a mass reduction due to heating. The mass reduction of the sol-gel silica particles due to heating from 30° C. to 250° C. at a rate of 30° C./min is preferably 1 mass % or more and 10 mass % or less.

When the mass reduction is 1 mass % or more, the sol-gel silica particles are inhibited from flowing on the toner particle surface and are kept being very uniformly dispersed on the toner particle surface, and thus the toner readily achieves an expected charge amount upon being stirred in a developing device. From this viewpoint, the mass reduction is more preferably 2 mass % or more, still more preferably 3 mass % or more.

When the mass reduction is 10 mass % or less, charge leakage through the sol-gel silica particles is inhibited, and thus the toner readily achieves an expected charge amount upon being stirred in a developing device. From this viewpoint, the mass reduction is more preferably 9 mass % or less, still more preferably 8 mass % or less.

In the exemplary embodiment, the mass reduction due to heating of the sol-gel silica particles is determined by the following measurement method.

About 30 mg of the sol-gel silica particles are placed in a sample chamber of a thermogravimetric analyzer (manufactured by Shimadzu Corporation, model number: DTG-60AH), and the temperature is raised from 30° C. to 250° C. at a rate of 30° C./min. The mass reduction is calculated from a difference between the initial mass and the mass after heating.

The sample subjected to the thermogravimetric analyzer is formed of sol-gel silica particles used as materials for the toner or sol-gel silica particles separated from the toner. The sol-gel silica particles may be separated from the toner by any method. For example, after ultrasonic waves are applied to a dispersion of the toner in surfactant-containing water, the dispersion is subjected to high-speed centrifugation, and the resulting supernatant fluid is dried at normal temperature (23° C.±2° C.) to obtain sol-gel silica particles.

When hydrophobized sol-gel silica particles are used as an external additive, the above measurement is conducted using sol-gel silica particles after being hydrophobized as a sample.

The sol-gel silica particles are obtained, for example, as described below.

Tetraalkoxysilane is added dropwise to an alkaline catalyst solution containing an alcohol compound and aqueous ammonia to hydrolyze and condense the tetraalkoxysilane, thereby forming a suspension containing sol-gel silica particles. Subsequently, the solvent is removed from the suspension to obtain a particulate substance. The particulate substance is then dried to obtain sol-gel silica particles. The average primary particle size of the sol-gel silica particles can be controlled by adjusting the ratio of the amount of added tetraalkoxysilane to the amount of alkaline catalyst solution. The water content of the sol-gel silica particles, that is, the mass reduction due to heating from 30° C. to 250° C. at a rate of 30° C./min, can be controlled by adjusting the conditions under which the particulate substance is dried.

From the viewpoint of image unevenness suppression, the average circularity of the external additive A is preferably 0.85 or more, more preferably 0.88 or more, still more preferably 0.90 or more, particularly preferably 0.92 or more and 0.995 or less.

Non-limiting examples of the method for controlling the average circularity of the external additive A to be within the above range include adjusting the temperature at which an alkaline catalyst and tetraalkoxysilane are mixed or the reaction time in the production of the sol-gel silica particles; and adjusting the concentration of the alkaline catalyst.

The average circularity of the external additive A and the external additive B in the exemplary embodiment is determined as described below.

The toner is embedded, for example, in an epoxy resin and cut, for example, with a diamond knife to prepare a thin section. The thin section is observed, for example, under a transmission electron microscope (TEM), and sectional images of a plurality of carrier particles are captured. In a sectional image of the external additive A in contact with the toner particles or the external additive B present on the external additive A, the circularity of 100 external additives A or 100 external additives B is calculated by formula (1) below. The circularity at 50% frequency accumulated from smaller circularities obtained is determined to be the average circularity of the external additives.

$$\text{circularity}=4\pi\times(A/I^2) \quad \text{Formula (1):}$$

In formula (1), I represents the peripheral length of an external additive in an image, and A represents the projected area of the external additive.

The number average particle size of the external additive A is preferably 20 nm or more and 120 nm or less.

When the number average particle size of the external additive A is 20 nm or more, the external additive A is less likely to be buried in the toner particles. From this viewpoint, the number average particle size of the external additive A is more preferably 25 nm or more, still more preferably 30 nm or more.

When the number average particle size of the external additive A is 120 nm or less, the external additive A is likely to stay on the surface of the toner particles. From this viewpoint, the number average particle size of the external additive A is more preferably 100 nm or less, still more preferably 90 nm or less.

In the exemplary embodiment, the number average particle size of an external additive is the diameter of a circle having the same area as a particle image (what is called an equivalent circle diameter) and is determined by capturing an electron microscope image of the toner to which the external additive is externally added and analyzing at least 300 external additives on the toner particles in the image. The number average particle size of the external additive is the particle size at which the cumulative number from smaller particle sizes is 50% in a number-based particle size distribution.

The external additive A may be formed of hydrophobic particles subjected to hydrophobic surface treatment. Any hydrophobizing agent may be used, and silicon-containing organic compounds are preferred. Examples of the silicon-containing organic compounds include alkoxysilane compounds, silazane compounds, and silicone oil. These may be used alone or in combination of two or more.

The hydrophobizing agent for the external additive A is preferably a silazane compound (e.g., dimethyldisilazane, trimethyldisilazane, tetramethyldisilazane, pentamethyldisilazane, or hexamethyldisilazane), particularly preferably 1,1,1,3,3,3-hexamethyldisilazane (HMDS).

The amount of the hydrophobizing agent is preferably 1 part by mass or more and 10 parts by mass or less based on 100 parts by mass of the external additive A.

Even when the external additive A is formed of hydrophobic particles subjected to hydrophobic surface treatment, the mass reduction due to heating is preferably in the above-described range, and the number average particle size is preferably in the above-described range.

In the exemplary embodiment, from the viewpoint of image unevenness suppression, the external additive A may contain a siloxane compound having a molecular weight of 200 or more and 600 or less. More preferably, the siloxane compound having a molecular weight of 200 or more and 600 or less may be attached to a part or the whole of the surface of the external additive A.

When the inorganic particles are hydrophobic inorganic particles subjected to hydrophobic surface treatment, the siloxane compound having a molecular weight of 200 or more and 600 or less may be attached to the hydrophobized surface of the inorganic particles.

The content of the external additive A based on the total mass of the toner particles is preferably 0.1 mass % or more and 10 mass % or less, more preferably 0.5 mass % or more and 8 mass % or less, still more preferably 1 mass % or more and 5 mass % or less.

Siloxane compound having molecular weight of 200 or more and 600 or less

In the exemplary embodiment, from the viewpoint of image unevenness suppression, the external additive A may contain a siloxane compound having a molecular weight of 200 or more and 600 or less. More preferably, the siloxane compound having a molecular weight of 200 or more and 600 or less may be attached to a part or the whole of the surface of the external additive A.

From the viewpoint of image unevenness suppression, the siloxane compound may be a compound consisting of a siloxane bond and an alkyl group.

To relatively increase the kinematic viscosity of the siloxane compound and thereby increase the frictional force acting between the inorganic particles, the molecular weight of the siloxane compound is 200 or more, preferably 250 or more, more preferably 280 or more, still more preferably 300 or more.

To relatively increase the conductivity of the siloxane compound and thereby relatively increase the dielectric constant of the toner, the molecular weight of the siloxane compound is 600 or less, preferably 550 or less, more preferably 500 or less, still more preferably 450 or less.

The number of Si atoms in one molecule of the siloxane compound having a molecular weight of 200 or more and 600 or less is at least 2.

To relatively increase the kinematic viscosity of the siloxane compound and thereby increase the frictional force acting between the inorganic particles, the number of Si atoms in one molecule of the siloxane compound having a molecular weight of 200 or more and 600 or less is preferably 3 or more, more preferably 4 or more, still more preferably 5 or more.

To relatively increase the conductivity of the siloxane compound and thereby relatively increase the dielectric constant of the toner, the number of Si atoms in one molecule of the siloxane compound having a molecular weight of 200 or more and 600 or less is preferably 7 or less, more preferably 6 or less, still more preferably 5 or less.

From the above two viewpoints, the number of Si atoms in one molecule of the siloxane compound having a molecular weight of 200 or more and 600 or less is particularly preferably 5.

To moderately increase the frictional force acting between the inorganic particles, the kinematic viscosity at 25° C. of the siloxane compound having a molecular weight of 200 or more and 600 or less is preferably 2 $mm^2/s$ or more and 5 $mm^2/s$ or less.

In the exemplary embodiment, the kinematic viscosity ($mm^2/s$) of a siloxane is a value obtained by dividing the viscosity of the siloxane at 25° C. measured using an Ostwald viscometer, which is a capillary viscometer, by the density of the siloxane.

One example of the siloxane compound having a molecular weight of 200 or more and 600 or less is a linear siloxane compound having no branched siloxane bonds.

Examples of such a linear siloxane compound having a molecular weight of 200 or more and 600 or less include hexaalkyldisiloxanes, octaalkyltrisiloxanes, decaalkyltetrasiloxanes, dodecaalkylpentasiloxanes, tetradecaalkylhexasiloxanes, and hexadecaalkylheptasiloxanes (whose molecular weights are 200 or more and 600 or less).

Examples of the alkyl group included in these linear siloxane compounds include linear alkyl groups having 1 to 10 carbon atoms (preferably 1 to 6 carbon atoms, more preferably 1 to 3 carbon atoms, still more preferably 1 or 2 carbon atoms), branched alkyl groups having 3 to 10 carbon atoms (preferably 3 to 6 carbon atoms, more preferably 3 or 4 carbon atoms), and cycloalkyl groups having 3 to 10 carbon atoms (preferably having 3 to 6 carbon atoms, more preferably 3 or 4 carbon atoms). Of these, alkyl groups having 1 to 3 carbon atoms are preferred, at least one of a methyl group and an ethyl group is preferred, and a methyl group is more preferred. Two or more alkyl groups in one molecule of the linear siloxane compound may be the same as or different from each other.

Specific examples of the linear siloxane compound having a molecular weight of 200 or more and 600 or less include octamethyltrisiloxane, decamethyltetrasiloxane, dodecamethylpentasiloxane, tetradecamethylhexasiloxane, and hexadecamethylheptasiloxane.

One example of the siloxane compound having a molecular weight of 200 or more and 600 or less is a branched siloxane having a branched siloxane bond.

Examples of such a branched siloxane compound having a molecular weight of 200 or more and 600 or less include branched siloxane compounds such as 1,1,1,3,5,5,5-heptaalkyl-3-(trialkylsiloxy)trisiloxanes, tetrakis(trialkylsiloxy)silanes, and 1,1,1,3,5,5,7,7,7-nonaalkyl-3-(trialkylsiloxy)tetrasiloxanes (whose molecular weights are 200 or more and 600 or less).

Examples of the alkyl group included in these branched siloxane compounds include linear alkyl groups having 1 to 10 carbon atoms (preferably 1 to 6 carbon atoms, more preferably 1 to 3 carbon atoms, still more preferably 1 or 2 carbon atoms), branched alkyl groups having 3 to 10 carbon atoms (preferably 3 to 6 carbon atoms, more preferably 3 or 4 carbon atoms), and cycloalkyl groups having 3 to 10 carbon atoms (preferably having 3 to 6 carbon atoms, more preferably 3 or 4 carbon atoms). Of these, alkyl groups having 1 to 3 carbon atoms are preferred, at least one of a methyl group and an ethyl group is preferred, and a methyl group is more preferred. Two or more alkyl groups in one molecule of the branched siloxane compound may be the same as or different from each other.

Specific examples of the branched siloxane compound having a molecular weight of 200 or more and 600 or less include methyltris(trimethylsiloxy)silane (molecular formula: $C_{10}H_{30}O_3Si_4$), tetrakis(trimethylsiloxy)silane (molecular formula: $C_{12}H_{36}O_4Si_5$), and 1,1,1,3,5,5,7,7,7-nonamethyl-3-(trimethylsiloxy)tetrasiloxane (molecular formula: $C_{12}H_{36}O_4Si_5$).

One example of the siloxane compound having a molecular weight of 200 or more and 600 or less is a cyclic siloxane compound having a cyclic structure consisting of siloxane bonds.

Examples of such a cyclic siloxane compound having a molecular weight of 200 or more and 600 or less include hexaalkylcyclotrisiloxanes, octaalkylcyclotetrasiloxanes, decaalkylcyclopentasiloxanes, dodecaalkylcyclohexasiloxanes, tetradecaalkylcycloheptasiloxanes, and hexadecaalkylcyclooctasiloxanes (whose molecular weights are 200 or more and 600 or less).

Examples of the alkyl group included in these cyclic siloxane compounds include linear alkyl groups having 1 to 10 carbon atoms (preferably 1 to 6 carbon atoms, more preferably 1 to 3 carbon atoms, still more preferably 1 or 2 carbon atoms), branched alkyl groups having 3 to 10 carbon atoms (preferably 3 to 6 carbon atoms, more preferably 3 or 4 carbon atoms), and cycloalkyl groups having 3 to 10 carbon atoms (preferably having 3 to 6 carbon atoms, more preferably 3 or 4 carbon atoms). Of these, alkyl groups having 1 to 3 carbon atoms are preferred, at least one of a methyl group and an ethyl group is preferred, and a methyl group is more preferred. Two or more alkyl groups in one molecule of the low-molecular-weight cyclic siloxane may be the same as or different from each other.

Specific examples of the cyclic siloxane compound having a molecular weight of 200 or more and 600 or less include hexamethylcyclotrisiloxane, octamethylcyclotetrasiloxane, decamethylcyclopentasiloxane, dodecamethylcyclohexasiloxane, tetradecamethylcycloheptasiloxane, and hexadecamethylcyclooctasiloxane.

For the toner including a siloxane compound to readily achieve an expected charge amount upon being stirred in a developing device, the siloxane compound having a molecular weight of 200 or more and 600 or less is preferably at least one selected from the group consisting of linear siloxane compounds and branched siloxane compounds, more preferably a branched siloxane compound, still more preferably a siloxane compound having a tetrakis structure. The siloxane having a tetrakis structure refers to a siloxane having in its molecule at least one structure represented by the following formula (i.e., tetrakissiloxysilane structure).

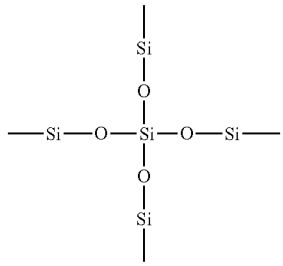

Examples of the siloxane compound having a tetrakis structure and a molecular weight of 200 or more and 600 or less include tetrakis(trialkylsiloxy)silanes, and examples of the alkyl group in the siloxane compound include alkyl groups having 1 to 10 carbon atoms (preferably 1 to 6 carbon atoms, more preferably 1 to 3 carbon atoms, still more preferably 1 or 2 carbon atoms), branched alkyl groups having 3 to 10 carbon atoms (preferably 3 to 6 carbon atoms, more preferably 3 or 4 carbon atoms), and cycloalkyl groups having 3 to 10 carbon atoms (preferably having 3 to 6 carbon atoms, more preferably 3 or 4 carbon atoms). Of these, alkyl groups having 1 to 3 carbon atoms are preferred, at least one of a methyl group and an ethyl group is preferred, and a methyl group is more preferred. The alkyl groups in one molecule of the siloxane compound having a tetrakis structure may be the same as or different from each other.

For the toner including a siloxane compound to readily achieve an expected charge amount upon being stirred in a developing device, the siloxane compound having a molecular weight of 200 or more and 600 or less is particularly preferably tetrakis(trimethylsiloxy)silane.

The total content of the siloxane compound having a molecular weight of 200 or more and 600 or less included in the toner is measured by a headspace method with a gas chromatograph mass spectrometer (manufactured by Shimadzu Corporation, GCMS-QP2020) and a nonpolar column (manufactured by Restek, Rtx-1, 10157, thickness: 1.00 μm, length: 60 m, inner diameter: 0.32 mm). Specifically, the measurement is performed by the following method.

The toner is weighed into a vial, and the vial is sealed with a cap and heated to 190° C. over 3 minutes. Subsequently, the volatilized component in the vial is introduced into the column, and the siloxane compound having a molecular weight of 200 or more and 600 or less is detected under the following conditions.

Carrier gas type: helium

Carrier gas pressure: 120 kPa (constant pressure)

Oven temperature: 40° C. (5 minutes)→(15° C./min)→250° C. (6 minutes) (25 minutes in total)

Ion source temperature: 260° C.

Interface temperature: 260° C.

A calibration curve is constructed using standard solutions prepared by diluting a reference material (tetrakis(trimethylsiloxy)silane 1) with ethanol and having different concentrations. The amount of the siloxane compound having a molecular weight of 200 or more and 600 or less is determined on the basis of a peak area of the siloxane compound that appears in a chromatograph of a sample and the calibration curve of the reference material. When there are two or more peaks attributed to the siloxane compound having a molecular weight of 200 or more and 600 or less in the chromatograph of the sample, the total amount of the siloxane compound is determined on the basis of the total area of the peak areas and the calibration curve of the reference material. Furthermore, the total content (ppm) of the siloxane compound having a molecular weight of 200 or more and 600 or less with respect to the total amount of the toner is calculated.

To increase the frictional force acting between the inorganic particles, the total content of the siloxane compound having a molecular weight of 200 or more and 600 or less in the external additive A, based on the total mass of the external additive A, is preferably 1 ppm or more, more preferably 5 ppm or more, still more preferably 10 ppm or more, even more preferably 15 ppm or more, yet even more preferably 20 ppm or more.

To prevent a decrease in dielectric constant of the toner, the total content of the siloxane compound having a molecular weight of 200 or more and 600 or less in the external additive A, based on the total mass of the external additive A, is preferably 1000 ppm or less, more preferably 500 ppm or less, still more preferably 200 ppm or less, even more preferably 100 ppm or less, yet even more preferably 50 ppm or less.

The above mass proportion is a value of {total content of siloxane compound having molecular weight of 200 or more and 600 or less in external additive A/total mass of external additive A in toner} expressed in parts per million.

When the external additive A is formed of hydrophobized inorganic particles, the mass of the external additive A refers to the mass of the external additive A after being hydrophobized, that is, the mass inclusive of the mass of components derived from the hydrophobizing agent.

The siloxane compound having a molecular weight of 200 or more and 600 or less can be incorporated into the external additive A, for example, by being externally added to the toner particles or by being used as a surface-treating agent for the external additive A (particularly, the sol-gel silica particles).

External Additive B

The electrostatic image developing toner according to the exemplary embodiment includes toner particles, an external additive A, and an external additive B. At least the external additive A is present on the surface of the toner particles, and at least the external additive B is present on the external additive A.

The whole external additive B included in the toner may be, but not necessarily, present on the external additive A. From the viewpoint of low-temperature fixability and color-streak suppressibility, 30 number % or more of the external additive B included in the toner is preferably present on the external additive A, 50 number % or more of the external additive B included in the toner is more preferably present on the external additive A, and 70 number % or more of the external additive B included in the toner is particularly preferably present on the external additive A.

The external additive B may be an aggregate of two or more particles. That is, the external additive B may be an aggregated particle (also referred to as a "secondary particle") formed by aggregation of two or more primary particles.

The external additive B is more preferably an aggregate of 2 to 10 particles, still more preferably an aggregate of 2 or 8 particles, particularly preferably an aggregate of 2 to 6 particles.

The external additive B is preferably formed of inorganic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and $SrTiO_3$.

Of these, silica particles, titania particles, or silica titania composite particles are preferred, and silica particles are particularly preferred.

Furthermore, from the viewpoint of fine-line reproducibility, the external additive B is preferably formed of particles prepared by a gas phase process (gas-phase-process particles), more preferably silica particles prepared by a gas phase process (gas-phase-process silica particles).

Furthermore, from the viewpoint of fine-line reproducibility, the external additive A may be formed of wet-process silica particles, and the external additive B may be formed of gas-phase-process silica particles.

In the electrostatic image developing toner according to the exemplary embodiment, from the viewpoint of low-temperature fixability and color-streak suppressibility, the coverage by the external additive B based on the total surface area of the toner particles is preferably 5 area % or more, more preferably 5 area % or more and 80 area % or less, still more preferably 5 area % or more and 60 area % or less, particularly preferably 10 area % or more and 30 area % or less.

In the electrostatic image developing toner according to the exemplary embodiment, from the viewpoint of low-temperature fixability and color-streak suppressibility, the coverage by the external additive A based on the total surface area of the toner particles is preferably 20 area % or more, more preferably 40 area % or more, particularly preferably 40 area % or more and 100 area % or less.

Furthermore, in the electrostatic image developing toner according to the exemplary embodiment, from the viewpoint of low-temperature fixability and color-streak suppressibility, the coverage by an external additive including the external additive A and the external additive B based on the total surface area of the toner particles is preferably 50 area % or more, more preferably 60 area % or more, particularly preferably 70 area % or more and 100 area % or less.

In the exemplary embodiment, the coverage by each external additive based on the total surface area of the toner particles is measured by the following measurement method.

The toner is observed under a scanning electron microscope (SEM) (S-4700, manufactured by Hitachi, Ltd.), and an image of the toner is captured. Using the captured image, the total surface area of the toner particles, the area of a region where the external additive A is attached, and the area of a region where the external additive B is attached are measured.

Next, the coverage by each external additive is calculated according to the following formulae.

external additive $B$ coverage [%]=(area of region where external additive $B$ is attached)/(total surface area of toner particles)×100 Formula (2):

external additive $A$ coverage [%]=(area of region where external additive $A$ is attached)/(total surface area of toner particles)×100 Formula (3):

From the viewpoint of low-temperature fixability and color-streak suppressibility, the average circularity of the external additive B is preferably 0.5 or more and 0.95 or less, more preferably 0.5 or more and 0.90 or less, particularly preferably 0.6 or more and 0.90 or less.

From the viewpoint of low-temperature fixability and color-streak suppressibility, the average primary particle size of the external additive B is preferably 5 nm or more and 100 nm or less, more preferably 10 nm or more and 80 nm or less, particularly preferably 10 nm or more and 60 nm or less.

From the viewpoint of low-temperature fixability and color-streak suppressibility, the number average particle size (secondary particle size) of the external additive B is preferably 50 nm or more and 300 nm or less, more preferably 100 nm or more and 250 nm or less, particularly preferably 120 nm or more and 200 nm or less.

From the viewpoint of low-temperature fixability and color-streak suppressibility, the content of the external additive B based on the total mass of the toner particles is preferably 0.1 mass % or more and 10 mass % or less, more preferably 0.25 mass % or more and 5 mass % or less, still more preferably 0.5 mass % or more and 3 mass % or less.

In the exemplary embodiment, from the viewpoint of low-temperature fixability and color-streak suppressibility, the value of $C^B/C^A$, where $C^A$ is a coverage by the external additive A based on the total surface area of the toner particles, and $C^B$ is a coverage by the external additive B based on the total surface area of the toner particles, is preferably 0.03 or more and 0.50 or less, more preferably 0.05 or more and 0.30 or less, particularly preferably 0.10 or more and 0.25 or less.

Furthermore, in the exemplary embodiment, from the viewpoint of low-temperature fixability and color-streak suppressibility, the number average particle size of the secondary particles of the external additive B is preferably larger than the number average particle size of the external additive A, the value of number average particle size of secondary particles of external additive B—number average particle size of external additive A is more preferably 10 nm or more and 200 nm or less, and the value of number average particle size of secondary particles of external additive B—number average particle size of external additive A is particularly preferably 30 nm or more and 150 nm or less.

Furthermore, in the exemplary embodiment, from the viewpoint of low-temperature fixability and color-streak suppressibility, the content of the external additive A is preferably higher than the content of the external additive B, and the value of content of external additive A/content of external additive B is more preferably more than 1 and 3 or less, still more preferably more than 1 and 2 or less, particularly preferably more than 1 and 1.5 or less.

Particles other than the external additive A and the external additive B may be included as external additives.

The number average particle sizes of the particles used as external additives other than the external additive A and the external additive B are each independently preferably 10 nm or more and 400 nm or less, more preferably 20 nm or more and 200 nm or less, particularly preferably 30 nm or more and 100 nm or less.

The external additives other than the external additive A and the external additive B are not particularly limited and may be formed of inorganic particles or organic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and $SrTiO_3$.

Examples of the organic particles include resin particles (particles of resins such as silicone, polystyrene, polymethyl methacrylate (PMMA), and melamine resins) and cleaning active agents (e.g., particles of higher fatty acid metal salts such as zinc stearate, and fluoropolymer particles).

From the viewpoint of low-temperature fixability and color-streak suppressibility, the content of the external additives other than the external additive A and the external additive B is preferably smaller than the content of the external additive A and the content of the external additive B.

Toner Particles

The electrostatic image developing toner according to the exemplary embodiment includes toner particles including a binder resin and a release agent. The toner particles have an average circularity of 0.8 or more and 0.94 or less, and the amount of the release agent present at the surface of the toner particles is 5 area % or more and 30 area % or less based on the total surface area of the toner particles.

The toner particles, for example, contain a binder resin, a release agent, and optionally a colorant and other additives. Preferably, the toner particles contain a binder resin, a colorant, and a release agent.

The average circularity of the toner particles is 0.8 or more and 0.94 or less. From the viewpoint of low-temperature fixability and color-streak suppressibility, it is preferably 0.82 or more and 0.94 or less, more preferably 0.85 or more and 0.94 or less.

The toner particles may be pulverized toner particles.

The electrostatic image developing toner according to the exemplary embodiment may be a pulverized toner.

The average circularity of the toner particles refers to an average circularity of the toner particles alone.

The average circularity of the toner particles is determined by (peripheral length of equivalent circle)/(peripheral length) [(peripheral length of circle having same projected area as that of particle image)/(peripheral length of projected particle image)]. Specifically, the average circularity is measured by the following method.

First, the toner (developer) to be measured is dispersed in water containing a surfactant, and then sonicated to obtain toner particles from which the external additive has been removed.

The toner particles obtained are collected by suction so as to form a flat flow, and strobe light is flashed to capture a still particle image. The particle image is analyzed with a flow particle image analyzer (FPIA-3000 manufactured by Sysmex Corporation). The number of particles sampled for determining the average circularity is 3,500.

The amount of release agent present at the surface of the toner particles is 5 area % or more and 30 area % or less based on the total surface area of the toner particles. From the viewpoint of low-temperature fixability and color-streak suppressibility, it is preferably 5 area % or more and 20 area % or less, particularly preferably 10 area % or more and 15 area % or less.

The amount of release agent present at the surface of toner particles of a commonly used polymerization toner is often about 2 area %.

In the exemplary embodiment, the measurement of the amount of release agent present at the surface of the toner particles is performed by the following method.

The amount of release agent present at the surface of the toner particles (surface release agent amount) is determined is by X-ray photoelectron spectroscopy (XPS). A JPS-9000MX manufactured by JEOL Ltd. is used as an XPS measurement apparatus. In the measurement, MgKα radiation is used as an X-ray source, the acceleration voltage is 10 kV, and the emission current is 30 mA. Here, a peak-separation method for a C1s spectrum is used to quantitatively determine the amount of release agent at the toner surface. In the peak-separation method, the measured C1s spectrum is separated into components by least-squares curve fitting. The component spectra used as the basis for separation are C1s spectra obtained by separately measuring the release agent and the binder resin used for the production of the toner particles.

Binder Resin

Examples of the binder resin include vinyl resins made of homopolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene); and vinyl resins made of copolymers of two or more of these monomers.

Other examples of the binder resin include non-vinyl resins such as epoxy resins, polyester resins, polyurethane resins, polyamide resins, cellulose resins, polyether resins, and modified rosins; mixtures of these non-vinyl resins and the above vinyl resins; and graft polymers obtained by polymerization of vinyl monomers in the presence of these non-vinyl resins.

In particular, styrene acrylic resins and polyester resins are suitable for use, and polyester resins are more suitable for use.

These binder resins may be used alone or in combination of two or more.

The binder resin may be an amorphous (non-crystalline) resin or a crystalline resin.

From the viewpoint of the image intensity of fine lines, the binder resin preferably includes a crystalline resin, more preferably includes an amorphous resin and a crystalline resin.

The content of the crystalline resin based on the total mass of the binder resin is preferably 2 mass % or more and 30 mass % or less, more preferably 5 mass % or more and 20 mass % or less.

"Crystalline" in the context of a resin means that the resin shows a distinct endothermic peak, rather than a stepwise change in the amount of heat absorbed, in differential scanning calorimetry (DSC). Specifically, it means that the half-width of the endothermic peak measured at a heating rate of 10° C./min is within 15° C.

"Amorphous" in the context of a resin means that the half-width exceeds 15° C., that a stepwise change in the amount of heat absorbed is shown, or that no distinct endothermic peak is observed.

The polyester resin may be, for example, a known polyester resin.

The polyester resin may be a combination of an amorphous polyester resin and a crystalline polyester resin. The content of the crystalline polyester resin based on the total mass of the binder resin is preferably 2 mass % or more and 30 mass % or less, more preferably 5 mass % or more and 20 mass % or less.

Amorphous Polyester Resin

Examples of the amorphous polyester resin include polycondensates of polycarboxylic acids with polyhydric alcohols. The amorphous polyester resin for use may be a commercially available product or may be synthesized.

Examples of the polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, and lower (e.g., C1 to C5) alkyl esters thereof. Of these, aromatic dicarboxylic acids are preferred, for example.

The polycarboxylic acid may be a combination of a dicarboxylic acid with a trivalent or higher valent carboxylic acid having a crosslinked or branched structure. Examples of the trivalent or higher valent carboxylic acid include trimellitic acid, pyromellitic acid, anhydrides thereof, and lower (e.g., C1 to C5) alkyl esters thereof.

These polycarboxylic acids may be used alone or in combination of two or more.

Examples of the polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these, aromatic diols and alicyclic diols are preferred, for example, and aromatic diols are more preferred.

The polyhydric alcohol may be a combination of a diol with a trivalent or higher valent polyhydric alcohol having a crosslinked or branched structure. Examples of the trivalent or higher valent polyhydric alcohol include glycerol, trimethylolpropane, and pentaerythritol.

These polyhydric alcohols may be used alone or in combination of two or more.

The glass transition temperature (Tg) of the amorphous polyester resin is preferably 50° C. or higher and 80° C. or lower, more preferably 50° C. or higher and 65° C. or lower.

The glass transition temperature is determined from a DSC curve obtained by differential scanning calorimetry (DSC). More specifically, the glass transition temperature is determined in accordance with "Extrapolation Glass Transition Onset Temperature" described in Determination of Glass Transition Temperature in JIS K7121-1987 "Testing Methods for Transition Temperatures of Plastics".

The weight average molecular weight (Mw) of the amorphous polyester resin is preferably 5,000 or more and 1,000,000 or less, more preferably 7,000 or more and 500,000 or less.

The number average molecular weight (Mn) of the amorphous polyester resin is preferably 2,000 or more and 100,000 or less.

The molecular weight distribution Mw/Mn of the amorphous polyester resin is preferably 1.5 or more and 100 or less, more preferably 2 or more and 60 or less.

The weight average molecular weight and the number average molecular weight are determined by gel permeation chromatography (GPC). The molecular weight determination by GPC is performed using an HLC-8120GPC system manufactured by Tosoh Corporation as a measurement apparatus, a TSKgel SuperHM-M column (15 cm) manufactured by Tosoh Corporation, and a THF solvent. The weight average molecular weight and the number average molecular weight are determined using a molecular weight calibration curve prepared from the measurement results relative to monodisperse polystyrene standards.

The amorphous polyester resin is produced by a known process. Specifically, the amorphous resin is produced, for example, by performing a polymerization reaction at a temperature of 180° C. to 230° C., optionally while removing water and alcohol produced during condensation by reducing the pressure in the reaction system.

If any starting monomer is insoluble or incompatible at the reaction temperature, it may be dissolved by adding a high-boiling solvent as a solubilizer. In this case, the polycondensation reaction is performed while distilling off the solubilizer. When a poorly compatible monomer is present, the poorly compatible monomer may be condensed with an acid or alcohol to be polycondensed with the monomer before being polycondensed with the major components.

Crystalline Polyester Resin

Examples of the crystalline polyester resin include polycondensates of polycarboxylic acids with polyhydric alcohols. The crystalline polyester resin for use may be a commercially available product or may be synthesized.

To easily form a crystalline structure, the crystalline polyester resin may be a polycondensate prepared from linear aliphatic polymerizable monomers rather than from aromatic polymerizable monomers.

Examples of the polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, and naphthalene-2,6-dicarboxylic acid), anhydrides thereof, and lower (e.g., C1 to C5) alkyl esters thereof.

The polycarboxylic acid may be a combination of a dicarboxylic acid with a trivalent or higher valent carboxylic acid having a cross-linked or branched structure. Examples of tricarboxylic acids include aromatic carboxylic acids (e.g., 1,2,3-benzenetricarboxylic acid, 1,2,4-benzenetricarboxylic acid, and 1,2,4-naphthalenetricarboxylic acid), anhydrides thereof, and lower (e.g., C1 to C5) alkyl esters thereof.

The polycarboxylic acid may be a combination of such a dicarboxylic acid with a dicarboxylic acid having a sulfonic group or a dicarboxylic acid having an ethylenic double bond.

These polycarboxylic acids may be used alone or in combination of two or more.

Examples of the polyhydric alcohols include aliphatic diols (e.g., linear aliphatic diols having 7 to 20 main-chain carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these, 1,8-octanediol, 1,9-nonanediol, and 1,10-decanediol are preferred.

The polyhydric alcohol may be a combination of a diol with a trivalent or higher valent alcohol having a cross-linked or branched structure. Examples of the trivalent or higher valent alcohol include glycerol, trimethylolethane, trimethylolpropane, and pentaerythritol.

These polyhydric alcohols may be used alone or in combination of two or more.

The amount of aliphatic diol in the polyhydric alcohol may be 80 mol % or more and is preferably 90 mol % or more.

The melting temperature of the crystalline polyester resin is preferably 50° C. or higher and 100° C. or lower, more preferably 55° C. or higher and 90° C. or lower, still more preferably 60° C. or higher and 85° C. or lower.

The melting temperature is determined from a DSC curve obtained by differential scanning calorimetry (DSC) in accordance with "Melting Peak Temperature" described in Determination of Melting Temperature of JIS K7121-1987 "Testing Methods for Transition Temperatures of Plastics".

The weight average molecular weight (Mw) of the crystalline polyester resin is preferably 6,000 or more and 35,000 or less.

The crystalline polyester resin is produced, for example, by a known method, as with the amorphous polyester resin.

From the viewpoint of scratch resistance of images, the weight average molecular weight (Mw) of the binder resin is preferably 5,000 or more and 1,000,000 or less, more preferably 7,000 or more and 500,000 or less, particularly preferably 25,000 or more and 60,000 or less. The number average molecular weight (Mn) of the binder resin is preferably 2,000 or more and 100,000 or less. The molecular weight distribution Mw/Mn of the binder resin is preferably 1.5 or more and 100 or less, more preferably 2 or more and 60 or less.

The weight average molecular weight and the number average molecular weight of the binder resin are determined by gel permeation chromatography (GPC). The molecular weight determination by GPC is performed using an HLC-8120GPC system manufactured by Tosoh Corporation as a measurement apparatus, a TSKgel SuperHM-M column (15 cm) manufactured by Tosoh Corporation, and a tetrahydrofuran (THF) solvent. The weight average molecular weight and the number average molecular weight are determined using a molecular weight calibration curve prepared from the measurement results relative to monodisperse polystyrene standards.

The content of the binder resin based on the total mass of the toner particles is preferably 40 mass % or more and 95 mass % or less, more preferably 50 mass % or more and 90 mass % or less, still more preferably 60 mass % or more and 85 mass % or less.

Release Agent

Examples of the release agent include hydrocarbon waxes; natural waxes such as carnauba wax, rice wax, and Candelilla wax; synthetic, mineral, and petroleum waxes such as montan wax; and ester waxes such as fatty acid esters and montanic acid esters, but are not limited thereto.

The melting temperature of the release agent is preferably 50° C. or higher and 110° C. or lower, more preferably 60° C. or higher and 100° C. or lower.

The melting temperature is determined from a DSC curve obtained by differential scanning calorimetry (DSC) in accordance with "Melting Peak Temperature" described in Determination of Melting Temperature of JIS K7121-1987 "Testing Methods for Transition Temperatures of Plastics".

From the viewpoint of low-temperature fixability and color-streak suppressibility, the domain size of the release agent in the toner particles is preferably 200 nm or more and 2,000 nm or less, more preferably 400 nm or more and 1,500 nm or less, still more preferably 500 nm or more and 1,300 nm or less, particularly preferably 600 nm or more and 1,200 nm or less.

The domain size (domain average size) of the release agent is a value determined by the following method.

The toner particles (or the toner) are mixed and embedded in an epoxy resin, and the epoxy resin is cured. The resulting cured resin is sliced with an ultramicrotome (Ultracut UCT manufactured by Leica Microsystems) to prepare a sample section having a thickness of 80 nm or more and 130 nm or less. The sample section is then stained with ruthenium tetroxide in a desiccator at 30° C. for 3 hours. An SEM image of the stained sample section is captured under a super-resolution field-emission scanning electron microscope (FE-SEM: S-4800 manufactured by Hitachi High-Technologies Corporation).

In sections of the toner particles, colorant domains are distinguishable by their size because they are smaller than release agent domains. Colorant domains are also distinguishable by the depth of the color of stained release agent domains.

In the SEM image, 30 toner particle sections having a maximum length larger than or equal to 85% of the volume average particle size of the toner particles are selected, and a total of 100 stained release agent domains are observed. The maximum length of each domain is measured as the length of the major axis of the domain, and the arithmetic average of the measured maximum lengths is calculated to determine the average size in the ° C. plane (domain size).

The content of the release agent based on the total mass of the toner particles is preferably 1 mass % or more and 20 mass % or less, more preferably 5 mass % or more and 15 mass % or less.

Colorant

Examples of the colorant include various pigments such as carbon black, chromium yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination of two or more.

Optionally, the colorant may be a surface-treated colorant or may be used in combination with a dispersant. The colorant may be a combination of different colorants.

For example, the content of the colorant based on the total mass of the toner particles is preferably 1 mass % or more and 30 mass % or less, more preferably 3 mass % or more and 15 mass % or less.

Other Additives

Examples of other additives include known additives such as magnetic materials, charge control agents, and inorganic powders. These additives are contained as internal additives in the toner particles.

Properties of Toner Particles

The toner particles may be toner particles having a single-layer structure or toner particles having, what is called, a core-shell structure composed of a core (core particle) and a coating layer (shell layer) covering the core (core-shell particles). The toner particles having a core-shell structure is composed of, for example, a core and a coating layer, the core containing a binder resin and optionally a colorant, a release agent, and the like, the coating layer containing a binder resin.

In particular, the toner particles may be core-shell particles from the viewpoint of low-temperature fixability and color-streak suppressibility.

The volume average particle size ($D_{50v}$) of the toner particles is preferably 2 μm or more and 10 μm or less, more preferably 4 μm or more and 8 μm or less.

The volume average particle size of the toner particles is measured using a COULTER MULTISIZER II (manufactured by Beckman Coulter, Inc.) and ISOTON-II electrolyte solution (manufactured by Beckman Coulter, Inc.).

In the measurement, 0.5 mg to 50 mg of a test sample is added to 2 mL of a 5 mass % aqueous solution of a surfactant (e.g., sodium alkylbenzene sulfonate) serving as a dispersant. The resulting solution is added to 100 mL to 150 mL of the electrolyte solution.

The electrolyte solution containing the suspended sample is dispersed with a sonicator for one minute, and the particle size of particles having particle sizes in the range of from 2 μm to 60 μm is measured with a COULTER MULTISIZER II using an aperture with an aperture size of 100 μm. The number of sampled particles is 50,000.

A volume-based cumulative distribution of the measured particle sizes is drawn from smaller particle sizes. The volume average particle size $D_{50v}$ is defined as the particle size at a cumulative volume of 50%.

In the exemplary embodiment, the average circularity of the toner particles is not particularly limited, but for improved cleaning of the toner off the image carrier, it is preferably 0.91 or more and 0.98 or less, more preferably 0.94 or more and 0.98 or less, still more preferably 0.95 or more and 0.97 or less.

In the exemplary embodiment, the circularity of a toner particle is expressed as (peripheral length of circle having the same area as projected particle image)/(peripheral length of projected particle image), and the average circularity of the toner particles is the circularity at a cumulative value of 50% from smaller circularities in a circularity distribution. The average circularity of the toner particles is determined by analyzing at least 3,000 toner particles with a flow particle image analyzer.

For example, when the toner particles are produced by aggregation and coalescence, the average circularity of the toner particles can be controlled by adjusting the rate of stirring a dispersion, the temperature of the dispersion, or the retention time in a fusion and coalescence step.

The amount of release agent in the toner particle surface can be controlled, for example, by adjusting the amount of charged release agent, the type of release agent, or the temperature during melt kneading, or performing a surface treatment with hot air after pulverization.

Method for Producing Toner

Next, a method for producing the toner according to the exemplary embodiment will be described.

The toner according to the exemplary embodiment is obtained by producing toner particles and then adding an external additive to the toner particles.

The toner particles may be produced by a dry process (e.g., kneading pulverization) or a wet process (e.g., aggregation and coalescence, suspension polymerization, or dissolution suspension). Not only these processes but any known process may be employed. Of these, kneading pulverization may be used to obtain the toner particles.

In the kneading pulverization, toner-forming materials including a binder resin, a release agent, and optionally a colorant are kneaded to obtain a kneaded mixture, and the kneaded mixture is then pulverized to thereby suitably prepare the toner particles.

The toner according to the exemplary embodiment is produced, for example, by adding an external additive to the dry toner particles obtained and mixing them together. The mixing may be performed, for example, with a V-blender, a Henschel mixer, or a Loedige mixer. Optionally, coarse toner particles may be removed using, for example, a vibrating screen or an air screen.

Electrostatic Image Developer

An electrostatic image developer according to an exemplary embodiment at least includes the toner according to the exemplary embodiment. The electrostatic image developer according to the exemplary embodiment may be a one-component developer including the toner according to the exemplary embodiment alone or a two-component developer including a mixture of the toner and a carrier.

The carrier may be any known carrier. Examples of the carrier include a coated carrier obtained by coating the surface of a core formed of a magnetic powder with a resin; a magnetic-powder-dispersed carrier obtained by dispersing and blending a magnetic powder in a matrix resin; and a resin-impregnated carrier obtained by impregnating a porous magnetic powder with a resin. The magnetic-powder-dispersed carrier and the resin-impregnated carrier may each be a carrier obtained by using the constituent particles of the carrier as cores and coating the surface of the cores with a resin.

Examples of the magnetic powder include magnetic metals such as iron, nickel, and cobalt and magnetic oxides such as ferrite and magnetite.

Examples of the resin for coating and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing organosiloxane bonds and modified products thereof, fluorocarbon resins, polyesters, polycarbonates, phenolic resins, and epoxy resins. The resin for coating and the matrix resin may contain additives such as conductive particles. Examples of the conductive particles include particles of metals such as gold, silver, and copper, carbon black, titanium oxide, zinc oxide, tin oxide, barium sulfate, aluminum borate, and potassium titanate.

An example method for coating the surface of the core with a resin is coating with a solution for coating layer formation obtained by dissolving the resin for coating and various additives (used as required) in an appropriate solvent. Any solvent may be selected by taking into account factors such as the type of resin used and coating suitability. Specific methods for coating the core with the coating resin include a dipping method in which the core is dipped in the solution for coating layer formation; a spraying method in which the surface of the core is sprayed with the solution for coating layer formation; a fluidized bed method in which the core is suspended in an air stream and sprayed with the solution for coating layer formation; and a kneader-coater method in which the carrier core and the solution for coating layer formation are mixed in a kneader-coater and the solvent then is removed.

The mixing ratio (mass ratio) of the toner to the carrier in the two-component developer is preferably 1:100 to 30:100, more preferably 3:100 to 15:100.

Image Forming Apparatus and Image Forming Method

An image forming apparatus according to an exemplary embodiment and an image forming method according to an exemplary embodiment will be described.

The image forming apparatus according to the exemplary embodiment includes an image carrier; a charging unit that charges a surface of the image carrier; an electrostatic image forming unit that forms an electrostatic image on the charged surface of the image carrier; a developing unit that contains an electrostatic image developer and develops, with the electrostatic image developer, the electrostatic image formed on the surface of the image carrier to form a toner image; a transfer unit that transfers the toner image formed on the surface of the image carrier onto a surface of a recording medium; and a fixing unit that fixes the toner image transferred onto the surface of the recording medium. As the electrostatic image developer, the electrostatic image developer according to the exemplary embodiment is used.

The image forming apparatus according to the exemplary embodiment executes an image forming method (the image forming method according to the exemplary embodiment) including a charging step of charging a surface of an image carrier, an electrostatic image forming step of forming an electrostatic image on the charged surface of the image carrier, a developing step of developing, with the electrostatic image developer according to the exemplary embodiment, the electrostatic image formed on the surface of the image carrier to form a toner image, a transferring step of transferring the toner image formed on the surface of the image carrier onto a surface of a recording medium, and a fixing step of fixing the toner image transferred onto the surface of the recording medium.

The image forming apparatus according to the exemplary embodiment may be a known type of image forming apparatus: for example, a direct-transfer apparatus that transfers a toner image formed on a surface of an image carrier directly to a recording medium; an intermediate-transfer apparatus that first transfers a toner image formed on a surface of an image carrier to a surface of an intermediate transfer body and then transfers the toner image transferred onto the surface of the intermediate transfer body to a surface of a recording medium; an apparatus including a cleaning unit that cleans a surface of an image carrier after the transfer of a toner image and before charging; or an apparatus including an erasing unit that erases charge on a surface of an image carrier by irradiation with erasing light after the transfer of a toner image and before charging.

When the image forming apparatus according to the exemplary embodiment is an intermediate-transfer apparatus, the transfer unit includes, for example, an intermediate transfer body having a surface to which a toner image is transferred, a first transfer unit that transfers a toner image formed on a surface of an image carrier to the surface of the intermediate transfer body, and a second transfer unit that transfers the toner image transferred onto the surface of the intermediate transfer body to a surface of a recording medium.

In the image forming apparatus according to the exemplary embodiment, the section including the developing unit may be, for example, a cartridge structure (process cartridge) attachable to and detachable from the image forming apparatus. For example, a process cartridge including a developing unit containing the electrostatic image developer according to the exemplary embodiment is suitable for use as the process cartridge.

A non-limiting example of the image forming apparatus according to the exemplary embodiment will now be described. In the following description, parts illustrated in the drawings are described, and other parts are not described.

FIG. 1 illustrates a schematic configuration of the image forming apparatus according to the exemplary embodiment.

The image forming apparatus illustrated in FIG. 1 includes first to fourth electrophotographic image forming units 10Y, 10M, 10C, and 10K which respectively output yellow (Y), magenta (M), cyan (C), and black (K) images based on color-separated image data. These image forming units (hereinafter also referred to simply as "units") 10Y, 10M, 10C, and 10K are arranged side by side at predetermined intervals in the horizontal direction. The units 10Y, 10M, 10C, and 10K may be process cartridges attachable to and detachable from the image forming apparatus.

An intermediate transfer belt 20 (an example of the intermediate transfer body) extends above the units 10Y, 10M, 10C, and 10K so as to pass through the units. The intermediate transfer belt 20 is wound around a drive roller 22 and a support roller 24, which are in contact with the inner surface of the intermediate transfer belt 20, and is configured to run in the direction from the first unit 10Y toward the fourth unit 10K. A spring or the like (not shown) applies a force to the support roller 24 in the direction away from the drive roller 22, so that tension is applied to the intermediate transfer belt 20 wound around the rollers 22 and 24. An intermediate transfer belt cleaning device 30 is provided on the image carrier side of the intermediate transfer belt 20 so as to face the drive roller 22.

The units 10Y, 10M, 10C, and 10K respectively include developing devices (examples of the developing unit) 4Y, 4M, 4C, and 4K to which yellow, magenta, cyan, and black toners are respectively supplied from toner cartridges 8Y, 8M, 8C, and 8K.

The first to fourth units 10Y, 10M, 10C, and 10K have the same structure and function. Thus, the first unit 10Y, which is disposed upstream in the running direction of the intermediate transfer belt and forms a yellow image, will be described as a representative.

The first unit 10Y includes a photoreceptor 1Y. The photoreceptor 1Y functions as an image carrier and is surrounded by, in sequence, a charging roller 2Y (an example of the charging unit), an exposure device 3 (an example of the electrostatic image forming unit), a developing device 4Y (an example of the developing unit), a first transfer roller 5Y (an example of the first transfer unit), and a photoreceptor cleaning device 6Y (an example of the image carrier cleaning unit). The charging roller 2Y charges the surface of the photoreceptor 1Y to a predetermined potential. The exposure device 3 exposes the charged surface to a laser beam 3Y based on a color-separated image signal to form an electrostatic image. The developing device 4Y supplies a charged toner to the electrostatic image to develop the electrostatic image. The first transfer roller 5Y transfers the developed toner image onto the intermediate transfer belt 20. The photoreceptor cleaning device 6Y removes the toner remaining on the surface of the photoreceptor 1Y after the first transfer.

The first transfer roller 5Y is disposed inside the intermediate transfer belt 20 so as to face the photoreceptor 1Y. The first transfer rollers 5Y, 5M, 5C, and 5K of the units are each connected to a bias power supply (not shown) that applies a first transfer bias. The value of transfer bias applied from each bias power supply to each first transfer roller is changed by control of a controller (not shown).

The operation of the first unit 10Y to form a yellow image will now be described.

Prior to the operation, the charging roller 2Y charges the surface of the photoreceptor 1Y to a potential of −600 V to −800 V.

The photoreceptor 1Y is formed of a conductive substrate (having a volume resistivity at 20° C. of, for example, $1\times10^{-6}$ Ωcm or less) and a photosensitive layer disposed on the substrate. The photosensitive layer, which normally has high resistivity (resistivity of common resins), has the property of, upon irradiation with a laser beam, changing its resistivity in an area irradiated with the laser beam. The exposure device 3 applies the laser beam 3Y to the charged surface of the photoreceptor 1Y on the basis of yellow image data sent from the controller (not shown). As a result, an electrostatic image with a yellow image pattern is formed on the surface of the photoreceptor 1Y.

The electrostatic image is an image formed on the surface of the photoreceptor 1Y by charging. Specifically, the electrostatic image is what is called a negative latent image formed in the following manner: in the area of the photosensitive layer irradiated with the laser beam 3Y, the resistivity drops, and the charge on the surface of the photoreceptor 1Y dissipates from the area, while the charge remains in the area not irradiated with the laser beam 3Y.

As the photoreceptor 1Y rotates, the electrostatic image formed on the photoreceptor 1Y is brought to a predetermined development position. At the development position, the electrostatic image on the photoreceptor 1Y is developed by the developing device 4Y to form a visible toner image.

The developing device 4Y contains, for example, an electrostatic image developer containing at least a yellow toner and a carrier. The yellow toner is frictionally charged as it is stirred inside the developing device 4Y, and thus has a charge with the same polarity (negative) as that of the charge on the photoreceptor 1Y and is held on a developer roller (an example of the developer holding body). As the surface of the photoreceptor 1Y passes through the developing device 4Y, the yellow toner is electrostatically attached to the neutralized latent image portion on the surface of the photoreceptor 1Y to develop the latent image. The photoreceptor 1Y on which the yellow toner image is formed continues to rotate at a predetermined speed to transport the toner image developed on the photoreceptor 1Y to a predetermined first transfer position.

When the yellow toner image on the photoreceptor 1Y is transported to the first transfer position, a first transfer bias is applied to the first transfer roller 5Y, and electrostatic force directed from the photoreceptor 1Y toward the first transfer roller 5Y acts on the toner image to transfer the toner image on the photoreceptor 1Y to the intermediate transfer belt 20. The transfer bias applied has the opposite polarity (positive) to the toner (negative). In the first unit 10Y, the transfer bias is controlled to, for example, +10 μA by the controller (not shown). The toner remaining on the photoreceptor 1Y is removed and collected by the photoreceptor cleaning device 6Y.

The first transfer biases applied to the first transfer rollers 5M, 5C, and 5K of the second to fourth units 10M, 10C, and 10K are controlled in the same manner as in the first unit.

Thus, the intermediate transfer belt 20 to which the yellow toner image is transferred by the first unit 10Y is sequentially transported through the second to fourth units 10M, 10C, and 10K, and as a result, toner images of the respective colors are transferred in a superimposed manner.

The intermediate transfer belt 20, to which the toner images of the four colors are transferred in a superimposed manner through the first to fourth units, runs to a second transfer section including the intermediate transfer belt 20, the support roller 24 in contact with the inner surface of the intermediate transfer belt, and a second transfer roller 26 (an example of the second transfer unit) disposed on the image carrier side of the intermediate transfer belt 20. A sheet of recording paper P (an example of the recording medium) is fed into the nip between the second transfer roller 26 and the intermediate transfer belt 20 at a predetermined timing by a feed mechanism, and a second transfer bias is applied to the support roller 24. The transfer bias applied has the same polarity (negative) as the toner (negative), and electrostatic force directed from the intermediate transfer belt 20 toward the recording paper P acts on the toner image to transfer the toner image on the intermediate transfer belt 20 to the recording paper P. The second transfer bias is determined depending on the resistance detected by a resistance detector (not shown) that detects the resistance of the second transfer section, and thus the voltage is controlled.

The recording paper P to which the toner image is transferred is sent to a pressure-contact part (nip part) between a pair of fixing rollers of a fixing device 28 (an example of the fixing unit), and the toner image is fixed to the recording paper P, thus forming a fixed image. The recording paper P after completion of the fixing of the color image is conveyed to a discharge unit. Thus, the color image forming operation is complete.

Examples of the recording paper P to which the toner image is transferred include plain paper for use in electrophotographic duplicators, printers, and other devices. Examples of recording media other than the recording paper P include OHP sheets. To further improve the surface smoothness of the fixed image, the surface of the recording paper P may also be smooth. For example, coated paper, i.e., plain paper coated with resin or the like and art paper for printing are suitable for use.

Process Cartridge and Toner Cartridge

A process cartridge according to an exemplary embodiment includes a developing unit that contains the electrostatic image developer according to the exemplary embodiment and that develops, with the electrostatic image developer, an electrostatic image formed on a surface of an image carrier to form a toner image. The process cartridge is attachable to and detachable from an image forming apparatus.

The process cartridge according to the exemplary embodiment may include the developing unit and optionally at least one selected from other units such as an image carrier, a charging unit, an electrostatic image forming unit, and a transfer unit.

A non-limiting example of the process cartridge according to the exemplary embodiment will now be described. In the following description, parts illustrated in the drawings are described, and other parts are not described.

Figure 2:
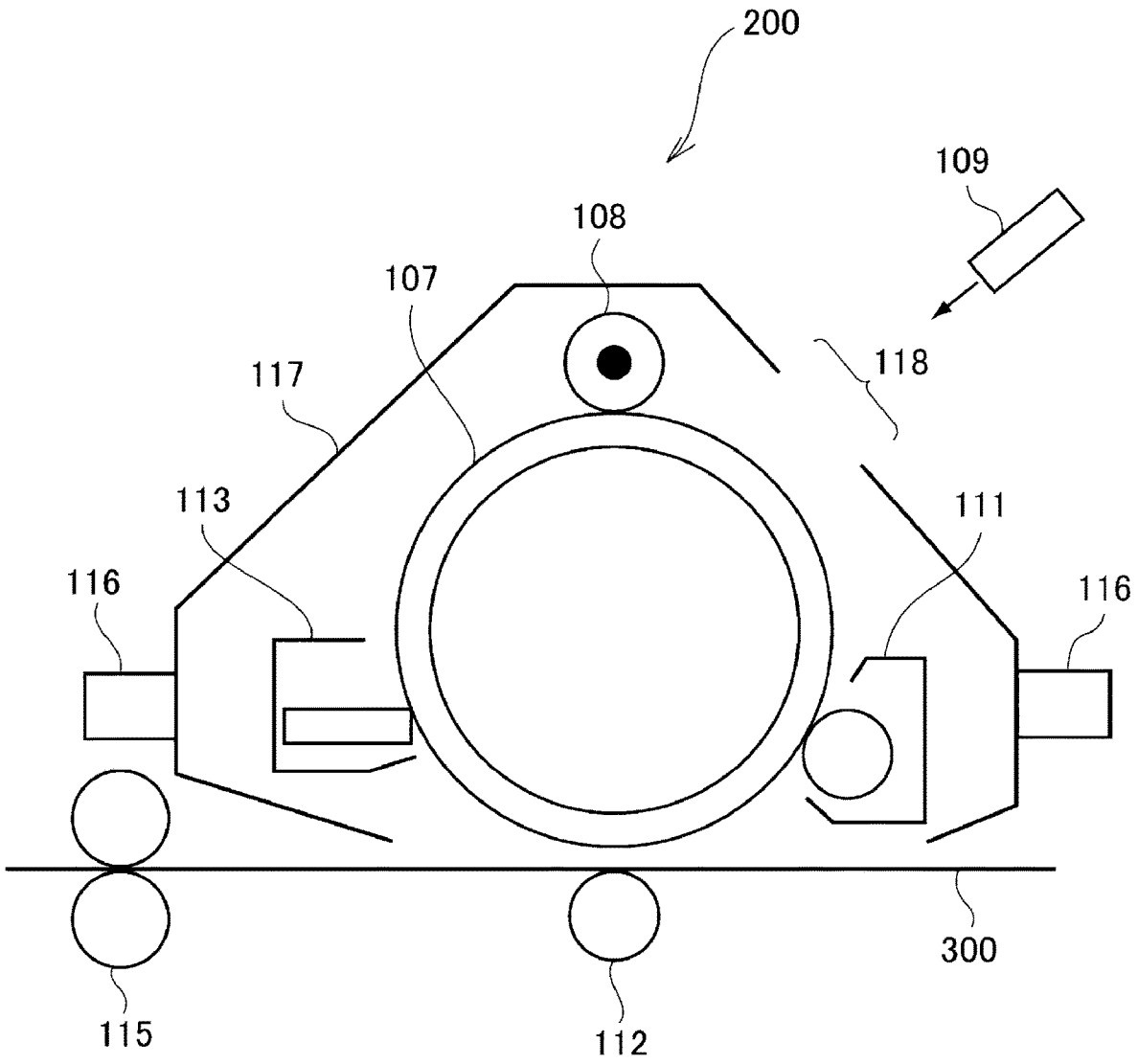
FIG. 2 illustrates a schematic configuration of a process cartridge according to an exemplary embodiment.

FIG. 2 illustrates a schematic configuration of an example of the process cartridge according to the exemplary embodiment.

A process cartridge 200 illustrated in FIG. 2 includes, for example, a photoreceptor 107 (an example of the image carrier), a charging roller 108 (an example of the charging unit) disposed on the periphery of the photoreceptor 107, a developing device 111 (an example of the developing unit), and a photoreceptor cleaning device 113 (an example of the cleaning unit). These units are combined and held together into a cartridge with a housing 117 having mounting rails 116 and an opening 118 for exposure.

In FIG. 2, 109 represents an exposure device (an example of the electrostatic image forming unit), 112 represents a transfer device (an example of the transfer unit), 115 represents a fixing device (an example of the fixing unit), and 300 represents a sheet of recording paper (an example of the recording medium).

Next, a toner cartridge according to an exemplary embodiment will be described.

The toner cartridge according to the exemplary embodiment contains the toner according to the exemplary embodiment and is attachable to and detachable from an image forming apparatus. The toner cartridge contains replenishment toner to be supplied to a developing unit provided in the image forming apparatus.

The image forming apparatus illustrated in FIG. 1 is configured such that the toner cartridges 8Y, 8M, 8C, and 8K are attachable thereto and detachable therefrom. The developing devices 4Y, 4M, 4C, and 4K are connected to the toner cartridges corresponding to the colors of the developing devices through toner supply tubes (not shown). The toner cartridges are replaced when the amount of toner therein is decreased.

EXAMPLES

Examples of the present disclosure will now be described, but the present disclosure is not limited to the following examples. In the following description, all parts and percentages are by mass unless otherwise specified.

In Examples, the coverage by each external additive, the average circularity of toner particles and each external additive, and the amount of release agent present at the surface of the toner particles are measured by the above-described methods.

Production of Sol-Gel Silica Particles ZG1

Step of Forming Silica Particles

In a glass reaction vessel equipped with a stirrer, a dropping nozzle, and a thermometer, 320 parts of methanol and 70 parts of 10% aqueous ammonia are placed and mixed together to obtain an alkaline catalyst solution. After the temperature of the alkaline catalyst solution is adjusted to 30° C., 45 parts of tetramethoxysilane (TMOS) and 14 parts of 10% aqueous ammonia are added dropwise while the alkaline catalyst solution is stirred, whereby a silica-particle dispersion is obtained. The addition of the TMOS and the addition of the 10% aqueous ammonia are started at the same time. It takes 6 minutes to add the whole amounts of the TMOS and the 10% aqueous ammonia. Next, the silica-particle dispersion is concentrated to a solids concentration of 40 mass % by using a rotary filter (R-fine manufactured by Kotobuki Industrial Co., Ltd.). The concentrated silica-particle dispersion is used as a silica-particle dispersion (1).

Step of Surface Treating Silica Particles

To 250 parts of the silica-particle dispersion (1), 100 parts of hexamethyldisilazane (HMDS) serving as a hydrophobizing agent are added, and the resulting mixture is heated to 130° C. and allowed to react for 2 hours, after which the reaction product is dried at 150° C. for 2 minutes to obtain hydrophobic silica particles (1). Next, tetrakis(trimethylsiloxy)silane is provided in an amount of 0.0010 mass % based on the amount of the silica-particle dispersion (1) and 5-fold diluted with methanol, and the diluted solution is then added to the hydrophobic silica particle (1). Drying is performed while the reaction system is stirred at 80° C. to obtain sol-gel silica particles ZG1.

The number average particle size of the sol-gel silica particles ZG1 is 75 nm. The content of the siloxane compound in the sol-gel silica particles ZG1 is 30 ppm.

Production of Sol-Gel Silica Particles ZG2

In a glass reaction vessel equipped with a stirrer, a dropping nozzle, and a thermometer, 320 parts of methanol and 70 parts of 10% aqueous ammonia are placed and mixed together to obtain an alkaline catalyst solution. After the temperature of the alkaline catalyst solution is adjusted to 30° C., 30 parts of tetramethoxysilane (TMOS) and 9 parts of 10% aqueous ammonia are added dropwise while the alkaline catalyst solution is stirred, whereby a silica-particle dispersion is obtained. The addition of the TMOS and the addition of the 10% aqueous ammonia are started at the same time. It takes 3 minutes to add the whole amounts of the TMOS and the 10% aqueous ammonia. Next, the silica-particle dispersion is concentrated to a solids concentration of 40 mass % by using a rotary filter (R-fine manufactured by Kotobuki Industrial Co., Ltd.). The concentrated silica-particle dispersion is used as a silica-particle dispersion (2).

Step of Surface Treating Silica Particles

To 250 parts of the silica-particle dispersion (2), 100 parts of hexamethyldisilazane (HMDS) serving as a hydrophobizing agent are added, and the resulting mixture is heated to 130° C. and allowed to react for 2 hours, after which the reaction product is dried at 150° C. for 2 minutes to obtain hydrophobic silica particles (2). Next, tetrakis(trimethylsiloxy)silane is provided in an amount of 0.010 mass % based on the amount of the silica-particle dispersion (2) and 5-fold diluted with methanol, and the diluted solution is then added to the hydrophobic silica particle (1). Drying is performed while the reaction system is stirred at 80° C. to obtain sol-gel silica particles ZG2. The number average particle size of the sol-gel silica particles ZG2 is 55 nm. The content of the siloxane compound in the sol-gel silica particles ZG2 is 30 ppm.

Production of Sol-Gel Silica Particles ZG3

In a glass reaction vessel equipped with a stirrer, a dropping nozzle, and a thermometer, 320 parts of methanol and 70 parts of 10% aqueous ammonia are placed and mixed together to obtain an alkaline catalyst solution. After the temperature of the alkaline catalyst solution is adjusted to 30° C., 180 parts of tetramethoxysilane (TMOS) and 9 parts of 50% aqueous ammonia are added dropwise while the alkaline catalyst solution is stirred, whereby a silica-particle dispersion is obtained. The addition of the TMOS and the addition of the 10% aqueous ammonia are started at the same time. It takes 30 minutes to add the whole amounts of the TMOS and the 10% aqueous ammonia. Next, the silica-particle dispersion is concentrated to a solids concentration of 40 mass % by using a rotary filter (R-fine manufactured by Kotobuki Industrial Co., Ltd.). The concentrated silica-particle dispersion is used as a silica-particle dispersion (3).

Step of Surface Treating Silica Particles

To 250 parts of the silica-particle dispersion (3), 100 parts of hexamethyldisilazane (HMDS) serving as a hydrophobizing agent are added, and the resulting mixture is heated to 130° C. and allowed to react for 2 hours, after which the reaction product is dried at 150° C. for 2 minutes to obtain hydrophobic silica particles (3). Next, tetrakis(trimethylsiloxy)silane is provided in an amount of 0.010 mass % based on the amount of the silica-particle dispersion (3) and 5-fold diluted with methanol, and the diluted solution is then added to the hydrophobic silica particle (1). Drying is performed while the reaction system is stirred at 80° C. to obtain sol-gel silica particles ZG3. The number average particle size of the sol-gel silica particles ZG3 is 120 nm. The content of the siloxane compound in the sol-gel silica particles ZG3 is 30 ppm.

Production of Sol-Gel Silica Particles ZG4

Sol-gel silica particles ZG4 are obtained in the same manner as the sol-gel silica particles ZG1 except that tetrakis(trimethylsiloxy)silane is not added in the step of surface treating the sol-gel silica particles ZG1. The number average particle size of the sol-gel silica particles ZG4 is 75 nm.

Production of Sol-Gel Silica Particles ZG5

Sol-gel silica particles ZG5 are obtained in the same manner as the sol-gel silica particles ZG1 except that tetrakis(trimethylsiloxy)silane is added in an amount of 0.01 mass % in the step of surface treating the sol-gel silica particles ZG1. The number average particle size of the sol-gel silica particles ZG5 is 75 nm. The content of the siloxane compound in the sol-gel silica particles ZG5 is 300 ppm.

Production of Toner Particles 1

Styrene-butyl acrylate copolymer (copolymerization ratio by mass=80:20, weight average molecular weight Mw=130,000, glass transition temperature Tg=59° C.): 88 parts Cyan pigment (C.I. pigment blue 15:3): 6 parts Paraffin wax (melting point=90° C.): 7 parts The above materials are mixed together with a Henschel mixer, and the mixture is heat kneaded with an extruder. After cooling, the kneaded mixture is subjected to coarse pulverization/fine pulverization, and the pulverized product is further classified to obtain toner particles 1 having a volume average particle size of 6.5 μm.

The surface release agent amount of the toner particles 1 is 13%. The average circularity of the toner particles 1 is 0.93.

Production of Toner Particles 2

Toner particles 2 are prepared in the same manner as the production of the toner particles 1 except that the pulverization strength is decreased.

The surface release agent amount of the toner particles 2 is 13%. The average circularity of the toner particles 2 is 0.93.

Production of Toner Particles 3

Toner particles 3 are prepared in the same manner as the production of the toner particles 1 except that the amount of paraffin wax is changed to 3 parts.

The surface release agent amount of the toner particles 3 is 6%. The average circularity of the toner particles 3 is 0.93.

Production of Toner Particles 4

Toner particles 4 are prepared in the same manner as the production of the toner particles 1 except that the amount of paraffin wax is changed to 12 parts.

The surface release agent amount of the toner particles 4 is 22%. The average circularity of the toner particles 4 is 0.93.

Production of Toner Particles 5

Toner particles 5 are prepared in the same manner as the production of the toner particles 1 except that the amount of paraffin wax is changed to 2 parts and a hot-air treatment is performed after the classification of the pulverized product.

The surface release agent amount of the toner particles 5 is 3%. The average circularity of the toner particles 5 is 0.97.

Production of Toner Particles 6

Toner particles 6 are prepared in the same manner as the production of the toner particles 1 except that the amount of paraffin wax is changed to 15 parts and a hot-air treatment is performed after the classification of the pulverized product.

The surface release agent amount of the toner particles 6 is 35%. The average circularity of the toner particles 6 is 0.97.

Example 1

Externally Added Toner 1

In a sample mill, 60 parts of the toner particles 1 and 1.2 parts of the sol-gel silica particles ZG1 are stirred at 10,000 rpm (revolutions per minute) for 30 seconds. Thereafter, 1.0 part of RY50 (manufactured by Nippon Aerosil Co., Ltd., number average particle size: 140 nm) are further added, and stirring at 16,000 rpm for 50 seconds is performed to produce an externally added toner 1.

Production of Electrostatic Image Developer

Eight parts by mass of the externally added toner 1 and 100 parts by mass of a resin-coated ferrite carrier (average particle size: 35 μm) are mixed together to prepare a two-component developer, whereby a developer (electrostatic image developer) is obtained.

Examples 2 to 12 and Comparative Examples 1 and 2

For Examples 2 to 12 and Comparative Examples 1 and 2, toners of Examples 2 to 12 and Comparative Examples 1 and 2 are produced in the same manner as in Example 1 except that resin-particle dispersions and release-agent-particle dispersions shown in Table 1 are used. For each toner, an electrostatic image developer is obtained in the same manner as in Example 1 except that an external additive shown in Table 1 is used.

Evaluation of Low-Temperature Fixability

Each of the developers is loaded into a developing device of a modified machine (a fixing machine is modified so as to have a variable fixing temperature) of Apeosport 6-C7771 manufactured by Fuji Xerox Co., Ltd. The surface temperature of a fixing roll of a fixing device is set to 160° C., and solid images with an area coverage of 100% (images with a toner mass per unit area of 3.8 g/m$^2$) are printed on a sheet of OS coated paper (trade name, manufactured by Oji Paper Co., Ltd.) at a process speed of 60 m/s.

Solid images formed in a leading end portion and a trailing end portion of the paper are visually observed to evaluate the state of image defects. The evaluation criteria are as described below. In the following evaluation criteria, A, B, and C are acceptable, and D is unacceptable.

A: No image defects are observed.

B: A very slight image defect is observed, but at a practically acceptable level.

C: A slight image defect is observed.

D: An image defect is observed.

Evaluation of Color-Streak Suppressibility

Each developer is left to stand in an environment at 28° C. and 85% RH for 24 hours, and then in the environment at 28° C. and 85% RH, an image with a low area coverage (area coverage: 1%) is continuously printed on 100,000 sheets of A4 paper using a modified machine of 700 Digital Color Press manufactured by Fuji Xerox Co., Ltd. The last 100 sheets are visually observed, and the occurrences of color streaks are classified according to the following criteria. A and B are at practically acceptable levels.

A: No color streaks occur.

B: Color streaks occur in 1 to 5 sheets.

C: Color streaks occur in 6 to 10 sheets.

D: Color streaks occur in 11 or more sheets.

The evaluation results are collectively shown in Table 1.

TABLE 1

| | Toner particles | | | External additive A | | | | | External additive B | |
|---|---|---|---|---|---|---|---|---|---|---|
| | Type | Average circularity | Surface release agent amount (area %) | Type | Number average particle size (nm) | Average circularity | Addition amount (parts by mass) | Content of siloxane compound (ppm) | Type | Number average particle size of secondary particles (nm) |
| Example 1 | 1 | 0.93 | 13 | ZG1 | 75 | 0.93 | 2.5 | 30 | RY50L | 120 |
| Example 2 | 1 | 0.93 | 13 | ZG1 | 75 | 0.93 | 2.5 | 30 | RY50L | 160 |
| Example 3 | 1 | 0.93 | 13 | ZG2 | 55 | 0.93 | 2.0 | 30 | RY50L | 160 |
| Example 4 | 1 | 0.93 | 13 | ZG1 | 75 | 0.93 | 2.5 | 30 | RY50L | 160 |
| Example 5 | 1 | 0.93 | 13 | ZG3 | 120 | 0.94 | 4.0 | 30 | RY50L | 160 |
| Example 6 | 1 | 0.93 | 13 | ZG1 | 75 | 0.93 | 2.5 | 30 | RY50L | 180 |
| Example 7 | 1 | 0.93 | 13 | ZG1 | 75 | 0.93 | 2.5 | 30 | RY50L | 200 |
| Example 8 | 2 | 0.88 | 13 | ZG1 | 75 | 0.93 | 2.5 | 30 | RY50L | 160 |
| Example 9 | 3 | 0.93 | 6 | ZG1 | 75 | 0.93 | 2.5 | 30 | RY50L | 160 |
| Example 10 | 4 | 0.93 | 22 | ZG1 | 75 | 0.93 | 2.5 | 30 | RY50L | 160 |
| Example 11 | 1 | 0.93 | 13 | ZG4 | 75 | 0.93 | 2.5 | 0 | RY50L | 200 |
| Example 12 | 1 | 0.93 | 13 | ZG5 | 75 | 0.93 | 2.5 | 300 | RY50L | 200 |

TABLE 1-continued

| | | | | | | | | | | |
|---|---|---|---|---|---|---|---|---|---|---|
| Comparative Example 1 | 5 | 0.97 | 3 | ZG1 | 75 | 0.93 | 2.5 | 30 | RY50L | 90 |
| Comparative Example 2 | 6 | 0.97 | 35 | ZG1 | 75 | 0.93 | 3.0 | 30 | none | — |

| | External additive B | | | | | | |
|---|---|---|---|---|---|---|---|
| | Average circularity | Addition amount (parts by mass) | Coverage by external additive A (%) | Coverage by external additive B (%) | Coverage by external additives (%) | Low-temperature fixability | Color-streak suppressibility |
| Example 1 | 0.72 | 1.0 | 45 | 5 | 50 | B | A |
| Example 2 | 0.70 | 1.5 | 45 | 20 | 65 | A | A |
| Example 3 | 0.70 | 1.5 | 45 | 20 | 65 | A | A |
| Example 4 | 0.70 | 1.5 | 45 | 20 | 65 | A | A |
| Example 5 | 0.70 | 1.5 | 44 | 20 | 64 | B | B |
| Example 6 | 0.68 | 2.0 | 45 | 30 | 75 | A | A |
| Example 7 | 0.68 | 3.0 | 45 | 40 | 85 | A | B |
| Example 8 | 0.70 | 1.5 | 45 | 20 | 65 | A | A |
| Example 9 | 0.70 | 1.5 | 45 | 20 | 65 | B | A |
| Example 10 | 0.70 | 1.5 | 45 | 20 | 65 | A | B |
| Example 11 | 0.68 | 1.5 | 45 | 20 | 65 | B | A |
| Example 12 | 0.68 | 1.5 | 45 | 20 | 65 | B | A |
| Comparative Example 1 | 0.75 | 0.5 | 45 | 2 | 47 | D | D |
| Comparative Example 2 | — | — | 50 | 0 | 50 | D | D |

In Table 1, "surface release agent amount (area %)" refers to "the amount (area %) of release agent present at the surface of toner particles based on the total surface area of the toner particles", and "height to outermost layer (nm)" refers to "height to outermost layer farthest from toner particles (length from toner particle surface to outer surface of outermost layer) (nm)".

The results shown in Table 1 indicate that the electrostatic image developing toners of Examples are superior in low-temperature fixability to the electrostatic image developing toners of Comparative Examples.

The results shown in Table 1 also indicate that the electrostatic image developing toners of Examples are superior in color-streak suppressibility.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic image developing toner comprising:

toner particles, each toner particle including a binder resin and a release agent;

an external additive A; and an external additive B, wherein at least the external additive A is present on a surface of the toner particles, at least the external additive B is present on the external additive A, the external additive B is an aggregate of two or more particles, the toner particles have an average circularity of 0.8 or more and 0.94 or less, an amount of the release agent present at the surface of the toner particles is 5 area % or more and 30 area % or less based on a total surface area of the toner particles, an amount of the release agent based on a total mass of the toner particles is 1 mass % or more and 20 mass % or less, the external additive A has an average circularity of 0.88 or more and 0.995 or less, and the external additive B has an average circularity of 0.5 or more and 0.85 or less.

2. The electrostatic image developing toner according to claim 1, wherein the external additive A contains a siloxane compound having a molecular weight of 200 or more and 600 or less.

3. The electrostatic image developing toner according to claim 2, wherein the siloxane compound is a compound consisting of a siloxane bond and an alkyl group.

4. An electrostatic image developing toner comprising:

toner particles, each toner particle including a binder resin and a release agent;

an external additive A; and an external additive B, wherein at least the external additive A is present on a surface of the toner particles, at least the external additive B is present on the external additive A, the external additive B is an aggregate of two or more particles, the toner particles have an average circularity of 0.8 or more and 0.94 or less, an amount of the release agent present at the surface of the toner particles is 5 area % or more and 30 area % or less based on a total surface area of the toner particles, wherein the external additive A contains a siloxane compound having a molecular weight of 200 or more and 600 or less, and wherein the siloxane compound includes a siloxane compound having a tetrakis structure.

5. The electrostatic image developing toner according to claim 3, wherein the siloxane compound includes a siloxane compound having a tetrakis structure.

6. The electrostatic image developing toner according to claim 2, wherein a content of the siloxane compound is 5 ppm or more and 1,000 ppm or less based on a total mass of the external additive A.

7. The electrostatic image developing toner according to claim 3, wherein a content of the siloxane compound is 5 ppm or more and 1,000 ppm or less based on a total mass of the external additive A.

8. The electrostatic image developing toner according to claim 4, wherein a content of the siloxane compound is 5 ppm or more and 1,000 ppm or less based on a total mass of the external additive A.

9. The electrostatic image developing toner according to claim 5, wherein a content of the siloxane compound is 5 ppm or more and 1,000 ppm or less based on a total mass of the external additive A.

10. The electrostatic image developing toner according to claim 4, wherein the external additive B has an average circularity of 0.5 or more and 0.95 or less.

11. The electrostatic image developing toner according to claim 1, wherein the external additive B has an average circularity of 0.5 or more and less than 0.75.

12. The electrostatic image developing toner according to claim 1, wherein a coverage of the toner particles by an external additive including the external additive A and the external additive B is 40 area % or more based on the total surface area of the toner particle.

13. The electrostatic image developing toner according to claim 1, wherein the toner particles are pulverized toner particles.

14. An electrostatic image developer comprising the electrostatic image wherein the toner according to claim 1.

15. A toner cartridge attachable to and detachable from an image forming apparatus, the toner cartridge comprising the electrostatic image developing toner according to claim 1.

16. A process cartridge attachable to and detachable from an image forming apparatus, the process cartridge comprising a developing unit that contains the electrostatic image developer according to claim 14 and develops, with the electrostatic image developer, an electrostatic image formed on a surface of an image carrier to form a toner image.

17. An image forming apparatus comprising:

an image carrier;

a charging unit that charges a surface of the image carrier;

an electrostatic image forming unit that forms an electrostatic image on the charged surface of the image carrier;

a developing unit that contains the electrostatic image developer according to claim 14 and develops, with the electrostatic image developer, the electrostatic image formed on the surface of the image carrier to form a toner image;

a transfer unit that transfers the toner image formed on the surface of the image carrier onto a surface of a recording medium; and a fixing unit that fixes the toner image transferred onto the surface of the recording medium.

18. An image forming method comprising:

charging a surface of an image carrier;

forming an electrostatic image on the charged surface of the image carrier;

developing, with the electrostatic image developer according to claim 14, the electrostatic image formed on the surface of the image carrier to form a toner image;

transferring the toner image formed on the surface of the image carrier onto a surface of a recording medium; and fixing the toner image transferred onto the surface of the recording medium.

* * * * *